US010226155B2

(12) United States Patent
Helfrich

(10) Patent No.: US 10,226,155 B2
(45) Date of Patent: Mar. 12, 2019

(54) TOILET SEAT AND TOILET LID LIFTER AND REMOTE TOILET FLUSHER

(71) Applicant: Michael Helfrich, Annapolis, MD (US)

(72) Inventor: Michael Helfrich, Annapolis, MD (US)

( * ) Notice: Subject to any disclaimer, the term of this patent is extended or adjusted under 35 U.S.C. 154(b) by 461 days.

(21) Appl. No.: 14/564,976

(22) Filed: Dec. 9, 2014

(65) Prior Publication Data

US 2016/0157683 A1 Jun. 9, 2016

(51) Int. Cl.
*A47K 13/10* (2006.01)
*E03D 5/08* (2006.01)

(52) U.S. Cl.
CPC ..... *A47K 13/10* (2013.01); *E03D 5/08* (2013.01)

(58) Field of Classification Search
CPC ..... A47K 13/10; E03D 5/04; E03D 5/08
USPC ..... 4/411; 220/262
See application file for complete search history.

(56) References Cited

U.S. PATENT DOCUMENTS 1,276,472 A * 8/1918 Zeen ..... A47K 13/10 4/246.4
2,155,548 A 4/1939 Hompesch
4,736,470 A * 4/1988 Classon ..... A47K 13/10 4/222
5,103,506 A * 4/1992 Munford ..... A47K 13/10 4/246.4
5,339,468 A 8/1994 Lin
5,488,743 A * 2/1996 Alfonso ..... A47K 13/10 4/246.1
5,594,958 A * 1/1997 Nguyen ..... A47K 13/10 4/246.5
5,875,498 A * 3/1999 Joseph ..... A47K 13/10 4/246.1
6,158,059 A * 12/2000 Zhang ..... A47K 13/10 4/246.1
6,263,517 B1 * 7/2001 Brooks ..... A47K 13/10 4/246.1
6,393,623 B1 * 5/2002 Strickland, Jr. ..... A47K 13/10 4/246.3
7,398,563 B2 * 7/2008 Chen ..... A47K 13/10 4/246.1
7,832,026 B1 * 11/2010 Bryant ..... A47K 13/10 4/246.1
7,987,528 B1 * 8/2011 Ross ..... A47K 13/10 4/246.3

(Continued)

OTHER PUBLICATIONS

PCT/US2015/064774 International Search Report and Written Opinion dated Feb. 12, 2016.

*Primary Examiner* — David Angwin
*Assistant Examiner* — William R Klotz
(74) *Attorney, Agent, or Firm* — Michael Best & Friedrich LLP

(57) ABSTRACT

A toilet seat and lid lifting and flushing device for connecting to a toilet. The toilet seat and lid lifting device includes a pedal operatively connected with a pivotal lid lever and a pivotal seat lever. A flush assembly includes a cable operatively connected to the pedal, a flush arm operatively connected to the cable, and a flush base receiving the flush arm. The seat lever is pivoted in a first direction upon application of a downward force to the pedal. The seat lever and the lid lever are pivoted in a second direction upon application of an upward force to the pedal. Application of an upward force to the pedal causes downward movement of the flush arm to initiate a flush cycle.

6 Claims, 9 Drawing Sheets

(56) References Cited

U.S. PATENT DOCUMENTS

| | | | | |
|---|---|---|---|---|
| 8,020,221 | B2 * | 9/2011 | Borochov | A47K 13/10 220/262 |
| 8,266,730 | B2 * | 9/2012 | Ricca | A47K 13/10 4/246.1 |
| 8,286,273 | B1 | 10/2012 | Toomer | |
| 2005/0005346 | A1 | 1/2005 | Eberle | |
| 2007/0044216 | A1 * | 3/2007 | Cosby | E03D 5/08 4/246.1 |
| 2008/0189843 | A1 | 8/2008 | Isaac | |
| 2011/0035866 | A1 | 2/2011 | Ricca | |

* cited by examiner

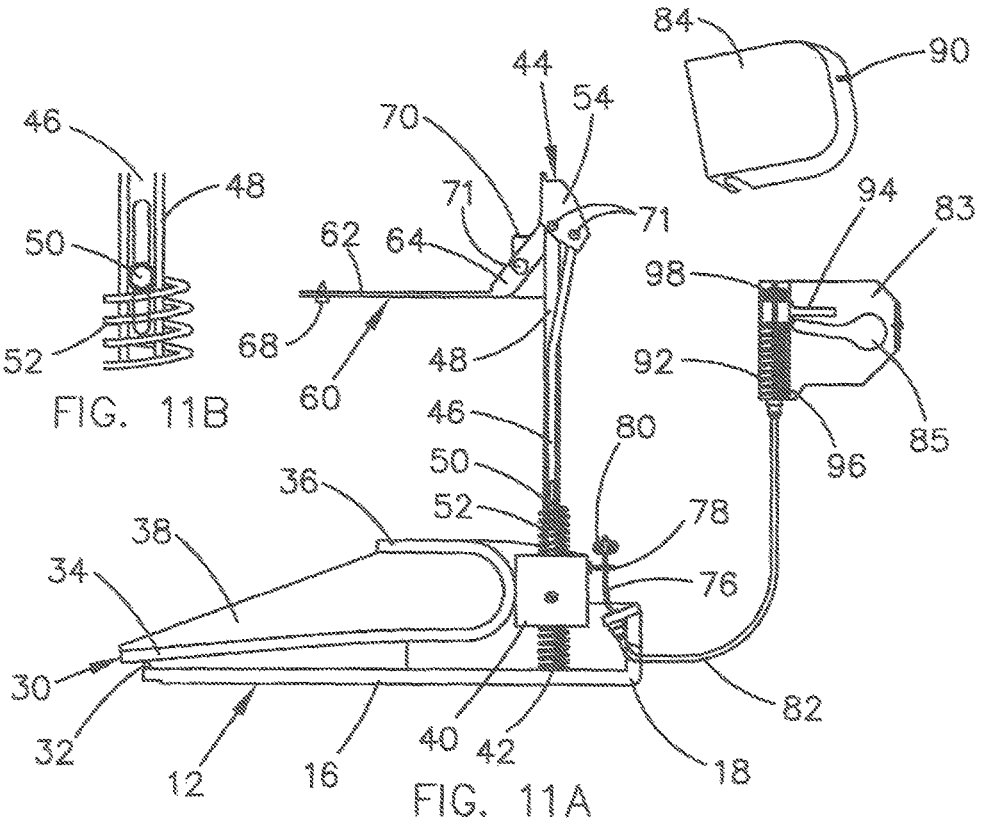
FIG. 11B
FIG. 11A
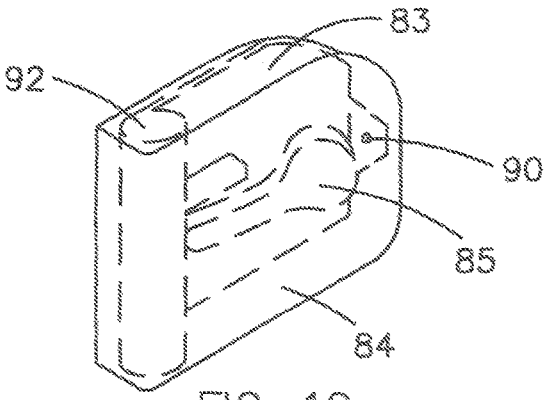
FIG. 12

TOILET SEAT AND TOILET LID LIFTER AND REMOTE TOILET FLUSHER

CROSS-REFERENCE TO RELATED APPLICATIONS

Related subject matter is disclosed in a further U.S. Patent Application filed concurrently herewith, by the same applicant, 14/565,041, titled "REMOVABLE TOILET SEAT LIFTER", the entire content of which is hereby incorporated by reference for all that is taught to provide greater detail or to describe additional aspects, but is in no way meant to limit or contradict the disclosure set forth herein or the construction of the appended claims.

BACKGROUND OF THE INVENTION

Field of the Invention

Various exemplary embodiments relate to devices for raising and lowering the seat of a commode or toilet as well as devices for flushing a commode or toilet.

Description of Related Art

Generally, toilet seat and/or lid lifting and lowering devices vary greatly, from simple structures pivotally connected to the toilet base, to complex mechanized and powered units. The former type does not totally eliminate unsanitary hand contact, nor does it eliminate possible arm, hand and back strain associated with manual operation. Mechanized and/or powered units often require complicated installation and/or permanent additions or modifications to the toilet, plumbing, and surrounding structure that are costly to manufacture and maintain.

SUMMARY

According to an exemplary embodiment, a toilet seat lifting device includes a pedal base, a pedal, a linkage, a lid lever, and a seat lever. The pedal pivotally connects to the pedal base. The linkage connects to the pedal. The lid lever extends from the linkage. The seat lever extends from the linkage.

According to one or more exemplary embodiments, a toilet seat lifting device and a flush assembly are provided. The toilet seat lifting device according to certain exemplary embodiments includes a pedal operatively connected with a pivotal lid lever and a pivotal seat lever. The flush assembly includes a cable operatively connected to the pedal, a flush arm operatively connected to the cable, and a flush base receiving the flush arm. The seat lever is pivoted in a first direction upon application of a downward force to the pedal. The seat lever and the lid lever are pivoted in a second direction upon application of an upward force to the pedal. Application of an upward force to the pedal causes downward movement of the flush arm.

According to another exemplary embodiment, a toilet seat lifting and flushing device are connected to a toilet. The toilet includes a toilet base, a toilet seat connected to the toilet base, a toilet lid connected to the toilet seat, a toilet tank connected to the toilet base, and a toilet handle connected to the toilet tank. A pedal base and a mounting bracket extending from the pedal base are connected to the toilet base. A pedal movably connects to the pedal base. A linkage connects to the pedal. The lid lever extends from the linkage behind the toilet lid. A seat lever extends from the linkage underneath the toilet seat. A pivot base extends from the lid lever connected to the toilet base.

BRIEF DESCRIPTION OF THE DRAWINGS

The aspects and features of various exemplary embodiments will be more apparent from the description of those exemplary embodiments taken with reference to the accompanying drawings, in which:

FIG. 11A is a right side view of a toilet seat lifter and a front schematic view of the flush assembly operatively connected to the toilet seat lifter and a toilet handle according to an exemplary embodiment;

FIG. 11B is an enlarged view of a spring connected to a linkage of FIG. 11A according to an exemplary embodiment;

FIG. 12 is a perspective, schematic view of a flush assembly flush housing engaging a toilet handle according to an exemplary embodiment;

DETAILED DESCRIPTION OF EXEMPLARY EMBODIMENTS

Figure 1:
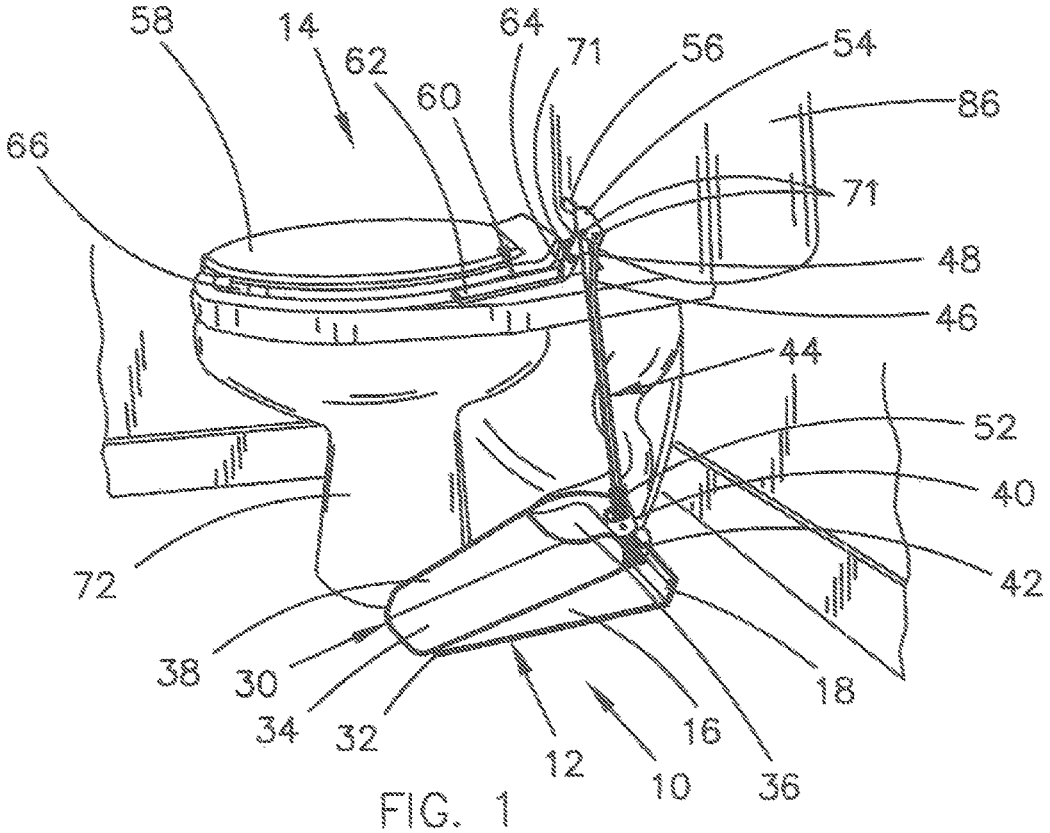
FIG. 1 is a perspective view of a toilet and a toilet seat lifter according to an exemplary embodiment with the toilet lid and toilet seat in a lowered position.
Figure 2:
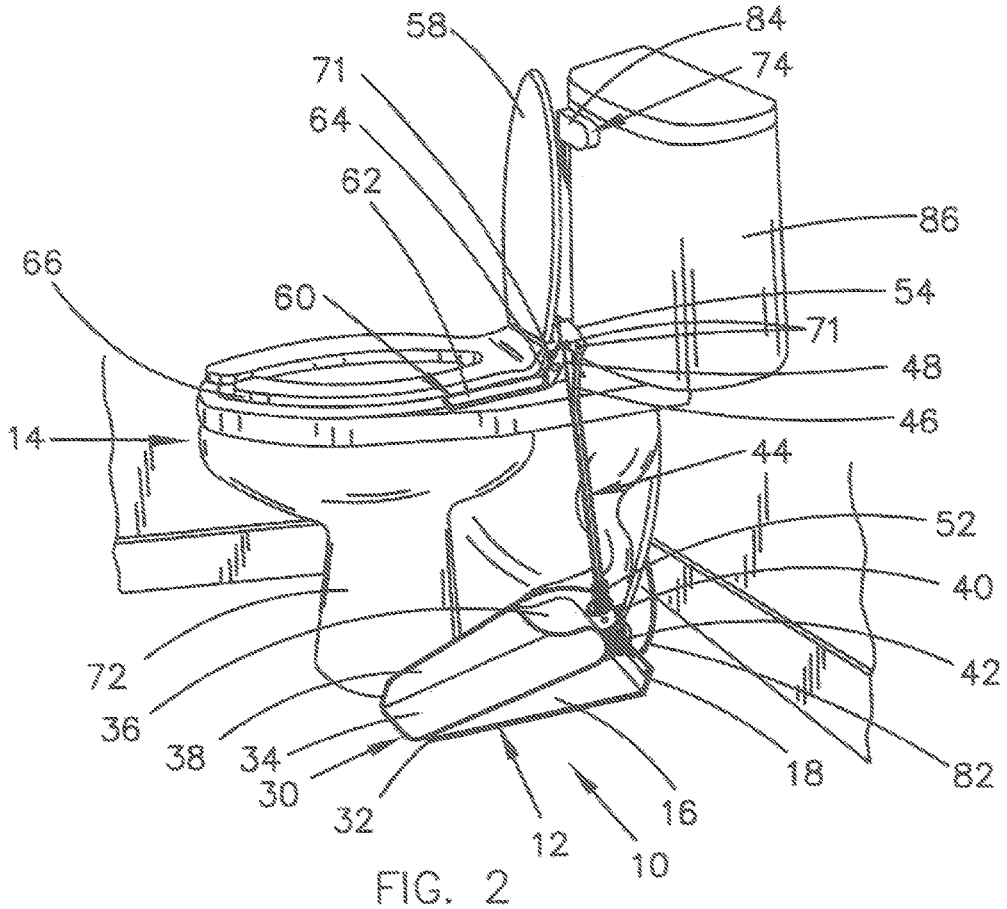
FIG. 2 is a perspective view of the toilet seat and lifter of FIG. 1 with the toilet lid in the raised position.
Figure 3:
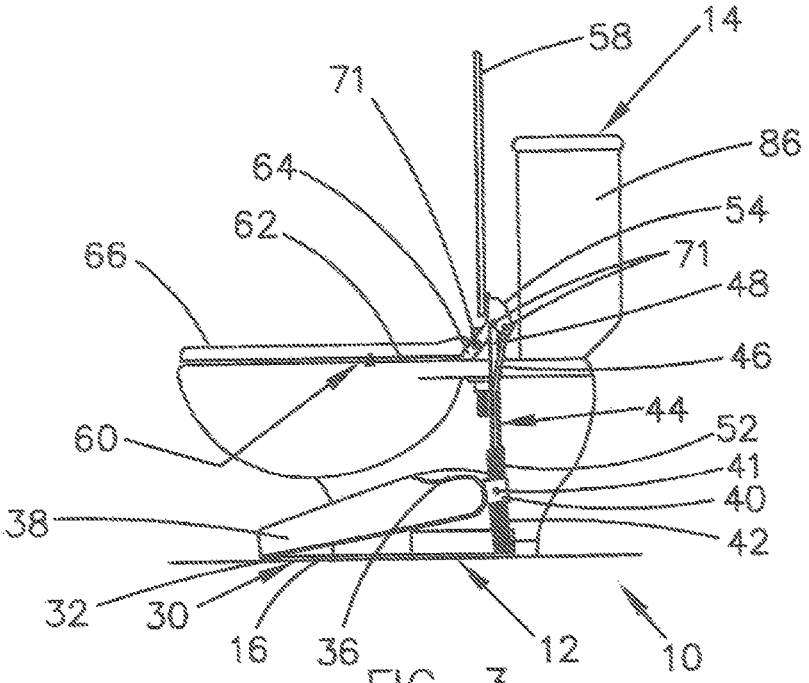
FIG. 3 is a right side elevational view of the toilet seat and lifter of FIG. 2.
Figure 4:
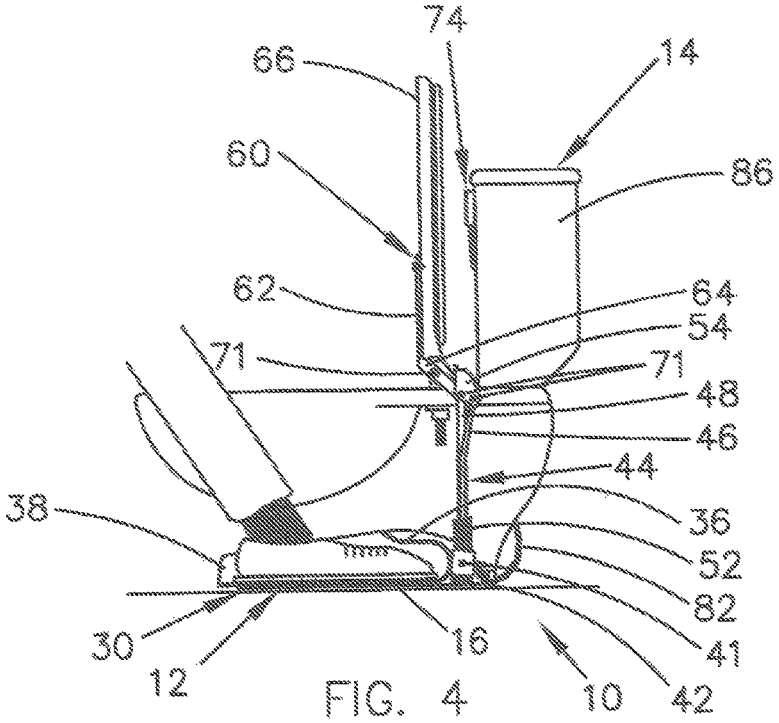
FIG. 4 is a right side elevational view of the toilet seat and lifter of FIG. 2 with a user's foot pressing down the pedal to raise the toilet seat and lid.

According to various exemplary embodiments, a toilet seat lifter 10 includes a pedal base 12 that rests on the floor next to a toilet 14. The pedal base 12 includes a bottom portion 16 and a rear wall 18. In the illustrated exemplary embodiment, the bottom portion 16 is a horizontal rectangular plate having a pair of substantially flat, planar surfaces, with a bottom surface in contact with a floor. The rear wall 18 has a rectangular first section extending from the bottom portion 16 away from the floor at a substantially right angle and a top section that extends obliquely from the first section towards the bottom portion 16. An aperture 20 is positioned in the top section. The bottom and rear portions 16, 18 may be unitarily formed or separately connected to one another. Different configurations for the pedal base 12 may be used, for example any rectilinear shape, curvilinear shape, or various combinations thereof, to conform to different toilets, meet size requirements, or for other utility and design considerations can be used and are within the scope of that which is contemplated by the inventor. The pedal base 12 may be made from a plastic, metal, ceramic, or composite material, or any combination thereof. In certain embodiments, the pedal base 12 is made from a stiff, lightweight material.

The pedal base 12 according to the present embodiment includes a mounting bracket 22. In various further embodiments, the mounting bracket 22 is unitarily formed with the bottom portion 16 and extends from the bottom portion 16 towards the toilet 14. The mounting bracket 22 includes a first part 24 and a second part 26 (see, for example FIG. 10). In the illustrated exemplary embodiment, the first part 24 is a trapezoidal, horizontal plate having a pair of substantially flat, planar surfaces, and the second part 26 is a rectangular, vertical plate extending from the first part 24 towards the floor. The first part 24 has an aperture 28, for example a slot or a hole, for receiving one or more fasteners to connect to the toilet 14. In an exemplary embodiment the aperture 28 receives the existing mounting hardware from the base of the toilet 14. The second part 26 extends from the first part 24 at a substantially right angle, although other angles can be used are required depending on the configuration of the lifter 10 and the toilet 14. The first and second parts 24, 26 may be unitarily formed or separately connected to one another.

Different configurations for the mounting bracket 22 may be used, for example a rectilinear shape, curvilinear shape, or various combinations thereof, to conform to different toilets, meet size requirements, or for other utility and design considerations may be used consistent with various embodiments. In various exemplary embodiments, the mounting bracket 22 can be part of the pedal base 12 or formed separately and connected to the pedal base 12, for example by a mechanical connection of suitable fastener. The mounting bracket 22 may be made from a plastic, metal, ceramic, or composite material, or any combination thereof. In certain embodiments, the mounting bracket 20 is made from metal and is coated, for example with paint, to help prevent corrosion.

A pedal 30 is pivotally connected to pedal base 12, for example via a pedal hinge 32 or other suitable pivotal connection. Pedal 30 receives a user's foot and is moveable towards and away from the pedal base 12 by application of a force from the user. The pedal includes a bottom 34, a toe lip 36 extending from the bottom 34, and an extension arm 38. In the illustrated exemplary embodiment, the bottom 34 is a substantially planar member with a bottom surface facing the pedal base 12 and an opposite top surface for receiving the user's foot. The toe lip 36 has a first curved section extending from the bottom 34 and a concave second curved section at its free end. The toe lip 36 receives upward force applied by a user's foot. The extension arm 38 extends from the pedal 30. Consistent with these and other embodiments bottom 34, toe lip 36, and extension arm 38 may be unitarily formed or separately connected in any combination. Different configurations for the pedal 30 may be used to conform to different toilets, meet size requirements, or for other utility and design considerations. The pedal 30 may be made from a plastic, metal, ceramic, or composite material, or any combination thereof. In certain embodiments, the pedal 30 is made from a stiff, lightweight material.

As best shown in FIG. 11A, and according to various embodiments, a housing 40 extends to the rear of the pedal 30. The housing 40 includes a substantially cylindrical member and may be formed integrally with any one or more of the bottom 34, toe lip 36, or the extension arm 38. For example, the housing 40 may curve from the extension arm 38 to form a substantially cylindrical member. In an alternative embodiment, the housing 40 is separately formed from the pedal 30 and connected thereto. The housing 40 may be made from a plastic, metal, ceramic, or composite material, or any combination thereof. In certain embodiments, the housing 40 is made from a stiff, lightweight material.

A first spring 42 is removably received by the housing 40 as desired by a user. The first spring 42 extends from the bottom of the housing 40 and contacts the pedal base 12 to bias the pedal 30 into an initial position. In this exemplary embodiment, the first spring 42 is a helical coil compression spring, although other biasing members may be used, such as a leaf spring, etc. In various alternative embodiments, the pedal base 12 includes structure, for example a slot, opening, counterbore, etc., (not shown) to receive and removably retain the first spring 42. Other mechanical connections, such as slots, clips, or fasteners, (not shown) may also be used to releasably retain the first spring 42. In other embodiments, the first spring 42 is permanently mounted to the housing 40 and the pedal base 12 or the first spring 42 is connected directly to the pedal 30.

A linkage 44 is operatively connected to the pedal 30, for example extending from the top of the housing 40. According to the depicted exemplary embodiment, the linkage includes a first arm 46, a second arm 48, and a plate 54. The first and second arms 46, 48 each have a first end received in the housing 40 and a second end connected to the plate 54. The first and second arms 46, 48 are connected to the housing 40 by a pin 41, bolt, or other similar fastener. The first arm 46 has an opening for fixedly receiving the pin 41 and the second arm 48 has a slot 49 receives the pin 41 and allows the first end of the second arm to move relative to the pin 41. The housing 40 also receives a second spring 52 placed around the first and second arms 46, 48. The second spring 52 may be connected to or engage a fastener 50 that is connected to the second arm 48, preventing the spring from riding up the second arm 48 during operation. In this exemplary embodiment shown, the second spring 52 is a helical coil compression spring, although other biasing members may be used. The first and second arms 46, 48 may be made from a plastic, metal, ceramic, or composite material, or any combination thereof. In certain embodiments, the first and second arms 46, 48 are made from metal and are coated, for example with paint, to help prevent corrosion.

In various exemplary embodiments, the first and second arms 46, 48 are pivotally connected to the plate 54, for example through respective mechanical fasteners. A lid lever 56 extends outwardly from the plate 54 towards the toilet 14 to engage a toilet lid 58. The lid lever 56 may be attached to the toilet lid 58, for example through a fastener or adhesives. The lid lever 56 is a substantially rectangular tab integrally formed with the plate 54. In alternative embodiments, the lid lever 56 is formed separately and connected to the plate 54. The plate 54 and lid lever 56 may be made from a plastic, metal, ceramic, or composite material, or any combination thereof. In certain embodiments, the plate 54 and lid lever 56 are made from metal and are coated, for example with paint, to help prevent corrosion.

Figure 5:
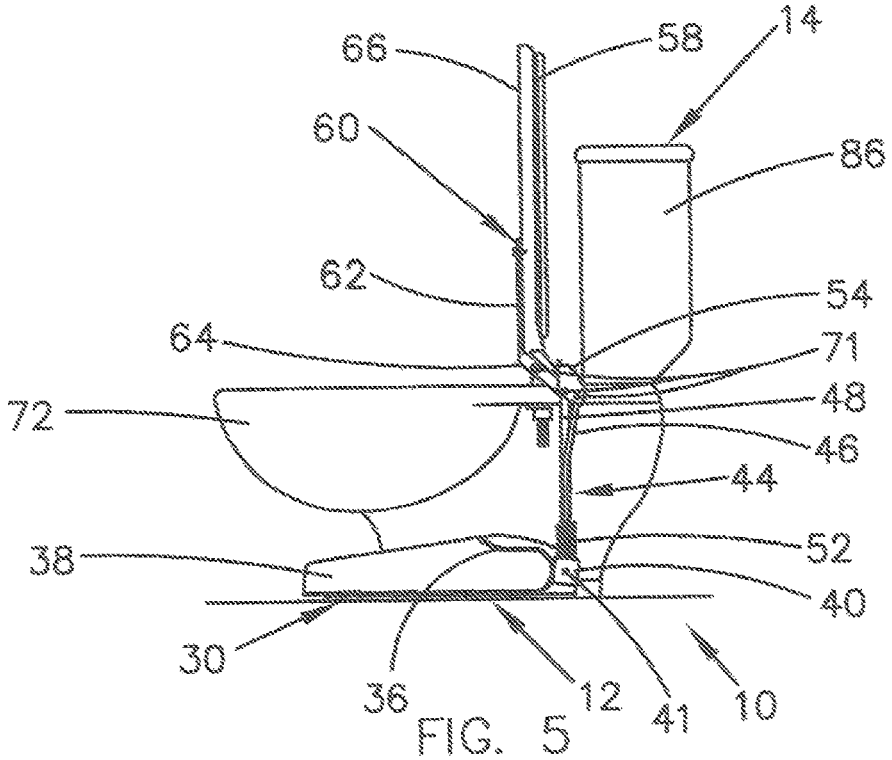
FIG. 5 is a right side elevational view of the toilet seat and lifter of FIG. 4 not showing the user's foot and with the removable spring removed to allow the toilet seat to remain upright.
Figure 6:
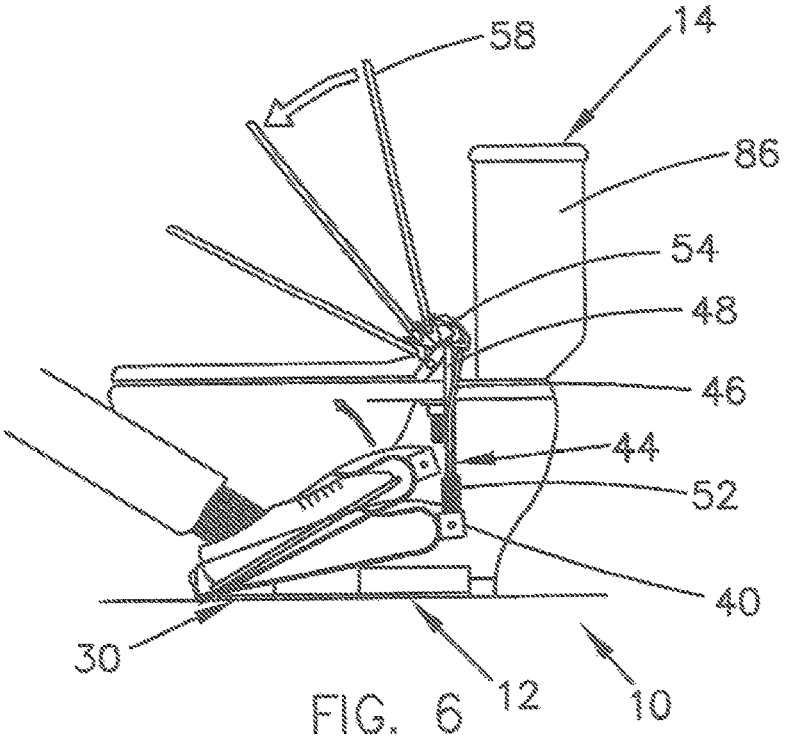
FIG. 6 is a right side elevational view of a toilet seat and lifter according to one or more embodiment depicting a user moving the pedal up to close the seat and lid.
Figure 10:
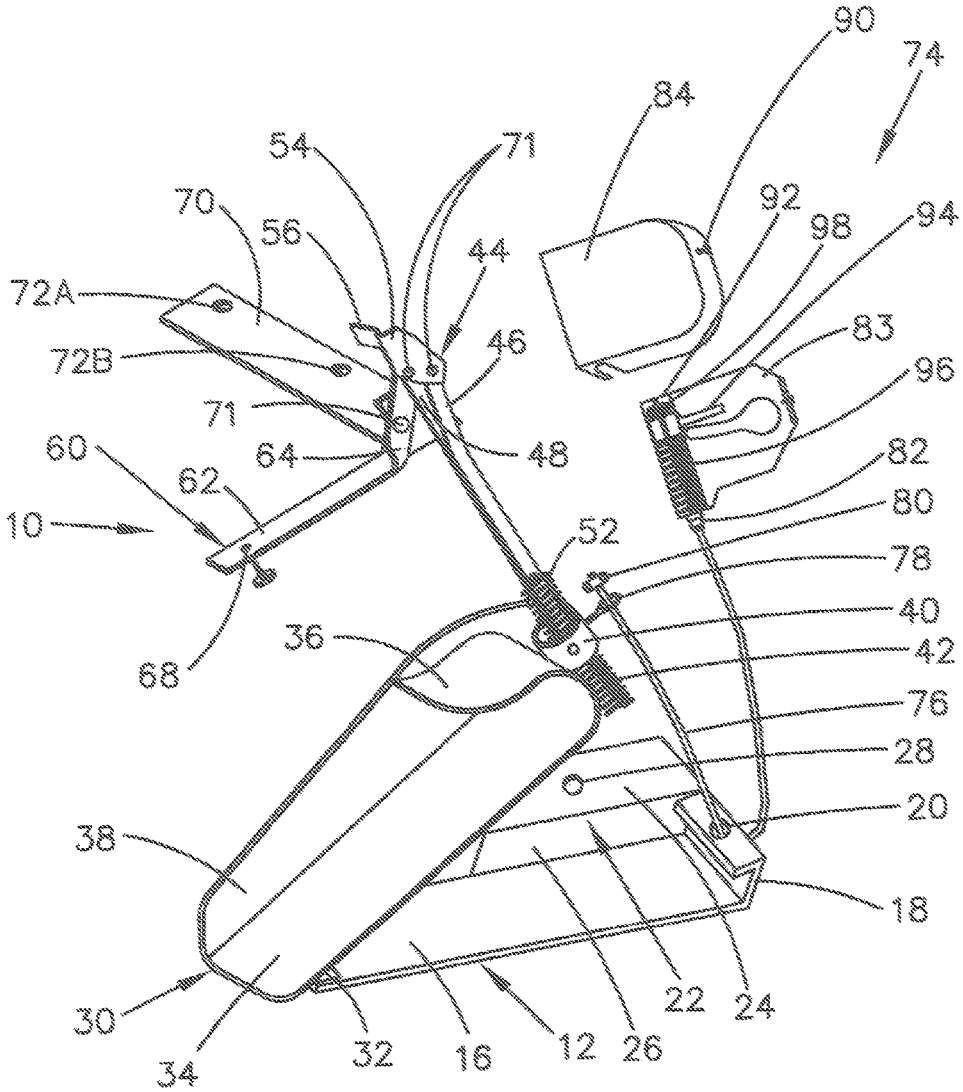
FIG. 10 is a perspective view of a toilet seat lifter and flush assembly according to an exemplary embodiment.
Figure 13:
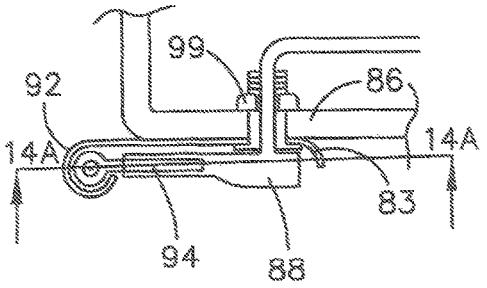
FIG. 13 is a top, schematic view of a flush assembly connected to a toilet tank according to an exemplary embodiment.
Figure 14A:
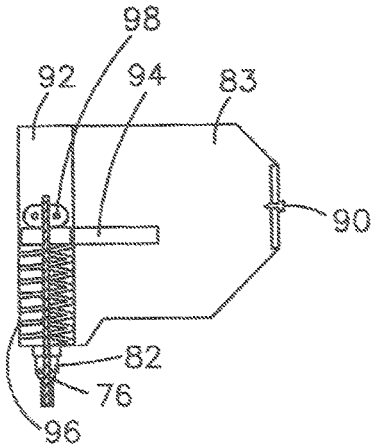
FIG. 14A is a front sectional view of the flush assembly of FIG. 13 taken along line 14A-14A.
Figure 14B:
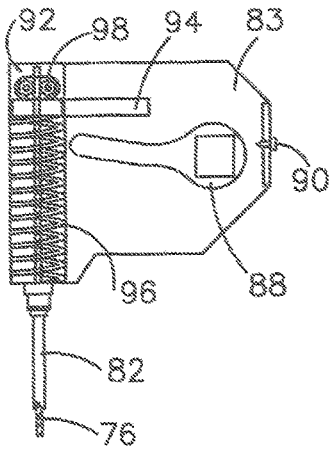
FIG. 14B is a front sectional view of the flush assembly of FIG. 13 taken along line 14A-14A and depicting a toilet handle with the flush arm in a raised position.
Figure 15:
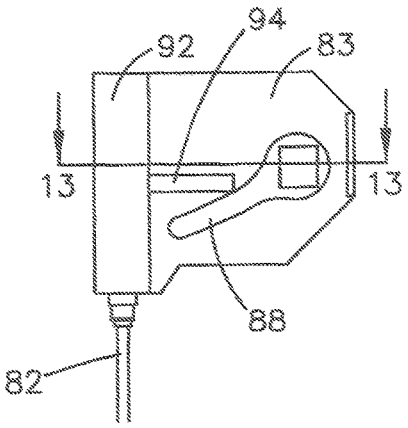
FIG. 15 is a front sectional view of the flush assembly of FIG. 13 depicting a toilet handle with the flush arm in a lowered position engaging the toilet handle.

A seat lever 60, shown for example in FIGS. 5, 10 and 11A, extends outwardly from the plate 54 towards the front of the toilet 14. The seat lever 60 is pivotally connected to the plate 54, for example through a mechanical fastener. In an exemplary embodiment, the seat lever 60 is connected to the plate 54 at the same point as the second arm 48. The seat lever 60 has a first section 62 extending obliquely to the plate 54 and a second section 64 extending obliquely to the first section 62. As best shown in the exemplary embodiment of FIG. 11A, the second section 64 is angled approximately 45 degrees to the first section 62. In various exemplary embodiments, the first section 62 is a rectangular plate having a substantially vertical orientation and the second section 64 is a rectangular plate having a substantially horizontal orientation. At least a portion of the seat lever 60 is positionable under a toilet seat 66. An aperture 68 is positioned proximate an end of the seat lever 60 to receive a fastener, for example a mounting screw, to mount the seat lever 60 to the toilet seat 66. In various alternative embodiments, the seat lever 60 is attached to the toilet seat 66 by an adhesive, strap, or hook-and-loop fastener. The first and second sections 62, 64 may be unitarily formed from a single piece of material with a bent or angled portion connecting the two sections 62, 64. The first and second sections 62, 64 may also be separately formed and connected together, for example through welding or fasteners. The seat lever 60 may be made from a plastic, metal, ceramic, or composite material, or any combination thereof. In certain embodiments, the seat lever 60 is made from metal and is coated, for example with paint, to help prevent corrosion.

Figure 7:
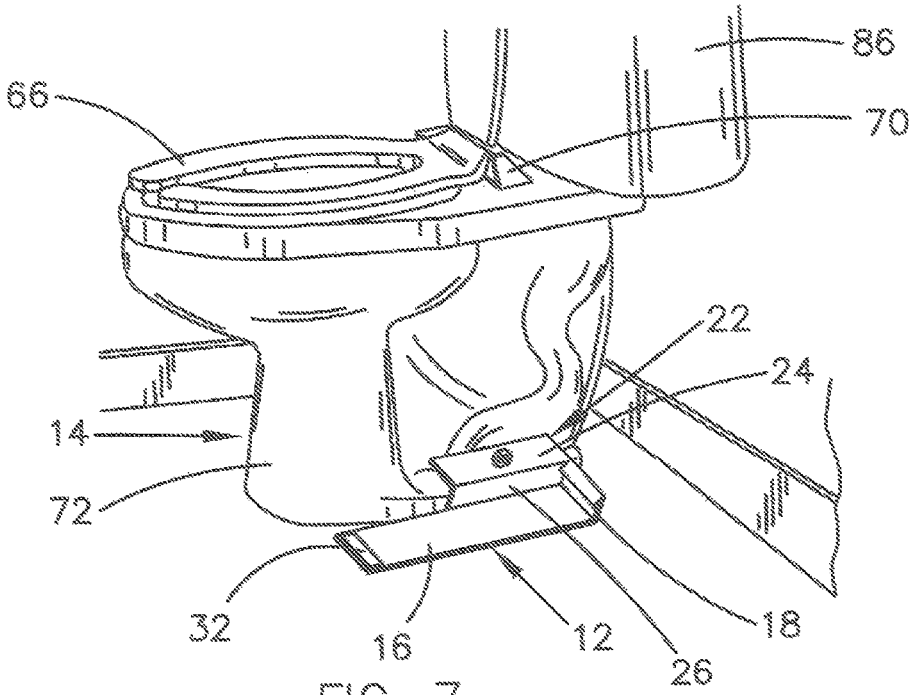
FIG. 7 is a perspective view of a pedal base and a pivot base connected to a toilet according to an exemplary embodiment.
Figure 8:
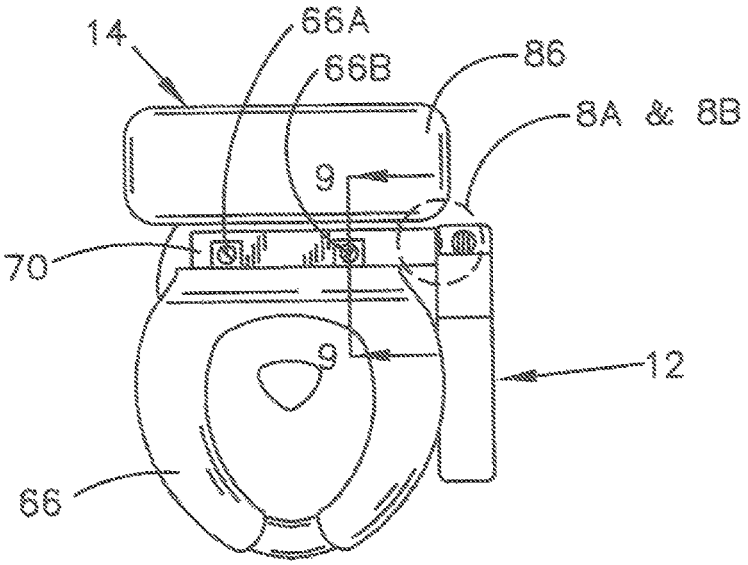
FIG. 8 is a top view of the toilet shown in FIG. 7.
Figure 8A:
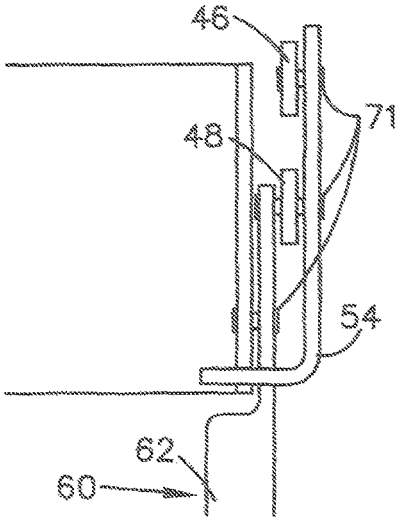
FIG. 8A is a partial, top plan view of the first arm, second arm, and plate.
Figure 8B:
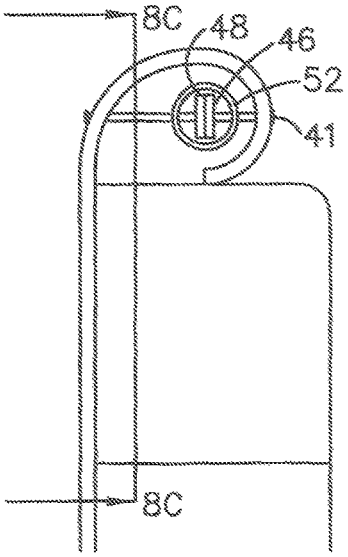
FIG. 8B is a partial, top plan view in section of the first arm, second arm, pin, and spring.
Figure 8C:
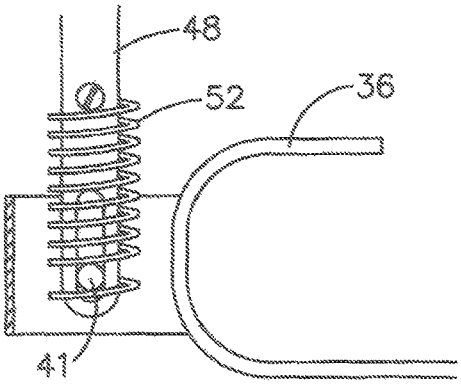
FIG. 8C is a side elevational view in section of the first arm, second arm, pin, and spring of FIG. 8B taken along line 8C-8C.
Figure 9:
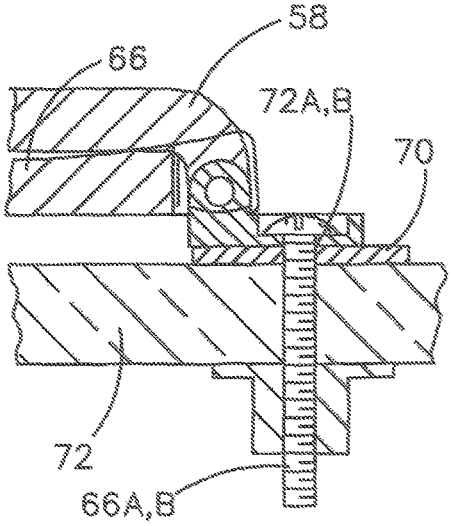
FIG. 9 is a partial, right side sectional view of the toilet shown in FIG. 8 taken along line 9-9.

A pivot base 70 extends from the seat lever 60 towards the center of the toilet 14. As best shown in the exemplary embodiment of FIGS. 7 and 10, the pivot base 70 is pivotally connected to the first section 62 of the seat lever 60 and extends substantially orthogonal thereto. The pivot base 70 is connected to the first section 62 through a fastener 71, such as a pin, bolt, or screw. The pivot base 70 is positionable under a toilet seat 66 and toilet lid 58 assembly. In various exemplary embodiments, the pivot base 70 includes a pair of apertures 72A, 72B to receive the existing toilet seat 66 mounting hardware. As best shown in FIG. 9, the pivot base 70 is positioned on the toilet base 72 and the apertures are aligned with the existing mounting holes. The toilet lid 58 and seat 66 are positioned over the pivot base 70 and secured to the toilet base 72 by a fastener 66A, 66B, for example a bolt and nut that may be part of the standard toilet 14 mounting hardware. The pivot base 70 may be made from a plastic, metal, ceramic, or composite material, or any combination thereof. In certain embodiments, the pivot base 70 is made from metal and is coated, for example with paint, to help prevent corrosion. In other exemplary embodiments, a toilet 14 can be manufactured to have an integral pivot base 70.

The toilet lifter 10 includes a flush assembly 74. In accordance with the exemplary embodiment shown in FIGS. 11-16, the flush assembly 74 includes a cable 76 having a first free end and a second free end. The cable 76 can include any suitable material, for example strands of metallic, polymer, or composite materials. The cable 76 is connected to the pedal 30 at an area proximate the first free end. In various exemplary embodiments, an eyelet 78 or some other attachment mechanism extends from the housing 40 having an opening with a substantially horizontal orientation, allowing the cable 76 to be passed through the eyelet 78. A first crimp 80, clamp, or other similar structure is connected to the cable 76 to prevent the cable 76 from being pulled through the eyelet 78.

Referring to the embodiment shown, for example, in FIG. 10, the cable 76 extends through one or more apertures 20 in the rear portion 18 of the pedal base 12. A sheath 82, gasket, or other similar member extends from the aperture 20 to ease the movement of the cable 76 and limit or prevent excessive wear and secure the sheath 82 to the aperture 20. The sheath 82 extends from the pedal base 12 to a flush housing having a flush base 83 and a flush cover 84, with the cable 76 extending through the sheath 82 and into the flush housing. The flush base 83 is positioned adjacent a toilet tank 86 and has an aperture to receive an existing toilet handle 88. The flush base 83 aperture may be a circular opening or a slot allowing the flush base 83 to slide into engagement behind the toilet handle 88. A flush cover 84 removably connects to the flush base 83. In various exemplary embodiments, the flush cover 84 completely or at least partially encloses the existing toilet handle 88 so that a flush cycle can only be initiated through the flush assembly 74. In other alternative embodiments, the flush cover 84 has one or more open sides to permit a user to selectively initiate a flush cycle from the flush assembly 74 or the toilet handle 88. One or more set screws 90 secure the flush cover 84 to the flush base 83. The flush base 83 is secured to the toilet 14 via the bushing and nut 99 provided with the toilet handle. In alternative embodiments, the flush housing is clipped or hung on the rim of the toilet tank 86. The flush assembly 74 may also connect directly to an existing toilet flush lever or chain positioned inside of the toilet tank 86.

According to various exemplary embodiments, the flush base 83 includes a tubular portion 92 receiving a flush arm 94 and a return spring 96. The tubular portion 92 is substantially cylindrical and has a side groove or slot allowing the flush arm 94 to extend from the housing 92 towards the toilet handle 88. The return spring 96 is retained in the housing positioned beneath the flush arm 94. In this exemplary embodiment, the return spring 96 is a helical coil compression spring, although other biasing members may be used. The cable 76 extends into the flush base 83, through the return spring 96 and the flush arm 94. A second crimp 98, clamp, or other similar structure is connected near the second free end of the cable 76 to prevent the cable 76 from pulling through the flush arm 94.

In operation, the pedal base 12 is placed next to the toilet 14 and the mounting bracket 22 is connected to the base of the toilet 14, for example using the existing toilet mounting hardware. The pivot base 70 is connected to the toilet base 72 and the seat lever 60 is positioned underneath a toilet seat 66. A user has the option of securing the lid lever 60 to the toilet seat 66 with a fastener. The flush assembly 74 is connected to the toilet 14 for engagement with the existing toilet handle 88. A user selectively connects the first spring 42 to the pedal base 12 and/or the pedal 30. In the initial position, the lid lever 56 is positioned substantially vertically, or at a less than vertical orientation.

As depicted in FIGS. 3-6, and in accordance with various exemplary embodiments, when a user steps on the pedal 30 and applies downward pressure the toilet seat 66 and lid 58 are raised. As the pedal 30 is pivoted towards the pedal base 12, the linkage 44 and plate 54 are moved down towards the pedal base 12, causing the seat lever 60 to pivot and raise the toilet seat 66 along with the lid 58. In various exemplary embodiments, during the downward movement, the plate 54 moves in a vertical direction, and substantially without rotation.

When the first spring 42 is not installed, cessation of downward force from a user, for example by the removal of the user's foot from the pedal 30, allows the toilet lid 58 and toilet seat 66 to remain in the raised position. In various alternative embodiments, the pedal 30 and linkage 44 are configured so that cessation of force causes the toilet seat 66 to close on its own. When the first spring 42 is installed, cessation of downward force from a user, for example by the removal of the user's foot from the pedal 30, allows the first spring 42 to bias the pedal 30 to an initial position, pivoting the seat lever 60 to its initial position and lowering the toilet seat 66.

After the toilet lid 58 and toilet seat 66 are raised, upward movement of the pedal 30 to a first position, either from a biasing force or from a user applying a force to the toe lip 36, lowers the toilet seat 66. Upward movement of the pedal 30 causes upward movement of the linkage 44, back toward the initial position, pivoting the seat lever 60 back towards the toilet base 72. Upward movement of the pedal 30 a greater distance past the first position causes the plate 54 to pivot, causing the lid lever 56 to engage and lower the toilet lid 58. In the exemplary embodiment, the first and second arms 46, 48 move downwardly together to and upwardly together to the initial position where the seat lever 60 is resting against the toilet base 72. As the pedal 30 is moved upwards from the initial position, the second arm 48 is restrained from moving further due to the engagement of the seat lever 60 with the toilet base 72, but the housing 40, pin 41, and the first arm 46 continue to move upwards with the pin 41 sliding through the slot 49 of the second arm 48 and compressing the second spring 52. Movement of the first arm 46 causes the plate 54 to pivot about the connection point of the second arm and seat lever 60, pivoting the lid lever 56 forward to engage and lower the toilet lid 58. Removal of the upward force to the pedal 30 allows the second spring 52 to decompress and return the linkage 44 to the initial position. In alternative embodiments, linkage and lid lever 56 are configured so that the lid lever 56 lowers the toilet lid 58 when the pedal 30 is in the initial position.

In various exemplary embodiments, upward movement of the pedal 30 beyond the initial position or the position that lowers the lid 58 actuates the flush assembly 74. The flush assembly 74 may be actuated at the first distance, where the lid lever 56 lowers the toilet lid 58, or at a second distance that is greater than the first distance with respect to the initial position. Movement of the pedal 30 causes the eyelet 78 to pull the first free end of the cable 76 upward by engagement with the first crimp 80. This movement draws the cable 76 through the sheath 82 so that the second free end of the cable 76 is pulled downward. When the second free end of the cable 76 is moved downward, the second crimp 98 pulls the flush arm 94 down against the bias of the return spring 96. The flush arm 94 engages the toilet handle 88, pivoting the toilet handle 88 down to initiate a flush cycle. After the upward force from the user's foot is removed, the return spring 96 returns the flush arm 94 to its initial position and the second spring 52 returns the pedal 30 and linkage 44 to their initial positions.

Various exemplary embodiments of the toilet seat lifter 10 and flush assembly 74 combine to provide a device that, through a single foot pedal 30, is capable of raising and lowering a toilet lid 58 and toilet seat 66 and ensure that the toilet lid 58 and toilet seat 66 are in a lowered, closed orientation prior to initiation of a flush cycle. The toilet seat lifter 10 also allows a user the option to have the toilet lid 58 automatically return to the lowered position when foot pressure is removed from the foot pedal 30. Certain embodiments of flush cover 74 prevent flush cycle initiation without use of the flush assembly 74, therefore, ensuring that the toilet seat 66 and lid 58 are closed prior to a toilet being flushed. This prevents what is termed the "aerosol effect" of soil contents of a recently used toilet being dispersed into the air above the toilet as a result of the turbulence created by flushing. The aerosol effect potentially contaminates the surrounding bathroom area, including tooth brushes and other personal items. The lifter 10 and flush assembly 72 also promote good health and hygiene by eliminating the need to touch a toilet seat 66, lid 58, and toilet handle 88. In various exemplary embodiments, the lifter device 10 and flush assembly 72 are configured to retro-fit to existing toilets 14 without modification to the existing toilet 14 and through cooperation with the existing mounting hardware and structure of the toilet.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A toilet seat lifting and flush device comprising:

a toilet seat lifting device having a pedal operatively connected with a pivotal lid lever and a pivotal seat lever; and a flush assembly having a cable operatively connected to said pedal, a flush arm operatively connected to said cable, and a flush base receiving said flush arm, wherein application of a force to said pedal in a first direction pivots said seat lever and said lid lever to raise a toilet lid and toilet seat, application of a force to said pedal in a second direction different from the first direction pivots said seat lever to lower the toilet seat, pivots said lid lever to lower the toilet lid, and causes said flush assembly to flush a toilet, and wherein movement of said pedal a first distance in said second direction lowers the toilet seat, movement of said pedal a second distance in said second direction lowers the toilet lid, and movement of said pedal a third distance in said second direction actuates the flush assembly.

2. The device of claim 1, wherein said flush assembly comprises a flush cover connected to said flush base and at least partially enclosing said flush arm and wherein said flush cover is configured to be positioned on the exterior of a toilet and said flush arm is configured to engage a toilet handle on the exterior of the toilet.

3. The device of claim 1, wherein said flush base retains a biasing member engaging said flush arm.

4. The device of claim 2, further comprising a sheath connected to said flush base and receiving said cable.

5. The device of claim 1, wherein the pedal is connected to the lid lever and the seat lever by a linkage, wherein said linkage comprises a first arm, a second arm, and a plate, and wherein the first arm includes a first end connected to the plate and a second end connected to the pedal by a pin fixed to the first arm and the second arm includes a first end connected to the plate and a slot receiving said pin to allow for relative movement of said pin with respect to said second arm.

6. The device of claim 1, wherein the pedal is pivotally connected to a pedal base, said pedal having a first end proximate a user and a second end distal to a user, said first end being pivotally connected to said pedal base.

* * * * *